US010610437B2

(12) United States Patent
Reynolds et al.

(10) Patent No.: US 10,610,437 B2
(45) Date of Patent: Apr. 7, 2020

(54) FULL-SIZED AND KEEPSAKE-SIZED CREMATION URNS

(71) Applicant: Batesville Services, Inc., Batesville, IN (US)

(72) Inventors: Kristine Ann Reynolds, Oldenburg, IN (US); Christopher M. Wessel, Metamora, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 16/174,968

(22) Filed: Oct. 30, 2018

(65) Prior Publication Data

US 2019/0231628 A1 Aug. 1, 2019

Related U.S. Application Data

(60) Provisional application No. 62/580,790, filed on Nov. 2, 2017.

(51) Int. Cl.
*A61G 17/08* (2006.01)

(52) U.S. Cl.
CPC ..... *A61G 17/08* (2013.01)

(58) Field of Classification Search
CPC ..... A61G 17/08; B65D 41/04
USPC ..... 27/1; 220/23.83, 288; 215/329
See application file for complete search history.

(56) References Cited

U.S. PATENT DOCUMENTS

| | | | | |
|---|---|---|---|---|
| 4,324,026 | A | 4/1982 | Craft | |
| 5,172,457 | A * | 12/1992 | Allen | A61G 17/08 248/146 |
| D344,390 | S | 2/1994 | May et al. | |
| D344,391 | S | 2/1994 | May et al. | |
| D344,839 | S | 3/1994 | May et al. | |
| D344,840 | S | 3/1994 | May et al. | |
| D345,848 | S | 4/1994 | May et al. | |
| D345,849 | S | 4/1994 | Parker | |
| D350,010 | S | 8/1994 | May et al. | |
| D356,421 | S | 3/1995 | Parker | |
| D356,422 | S | 3/1995 | Parker | |
| D359,831 | S | 6/1995 | Parker | |
| D360,732 | S | 7/1995 | Parker | |
| D370,766 | S | 6/1996 | Parker | |
| D370,767 | S | 6/1996 | Parker | |
| D370,768 | S | 6/1996 | Parker | |
| D385,081 | S | 10/1997 | Parker | |
| 5,709,441 | A | 1/1998 | Bartling et al. | |
| D401,732 | S | 11/1998 | Parker | |

(Continued)

*Primary Examiner* — William L Miller
(74) *Attorney, Agent, or Firm* — Wood Herron & Evans LLP

(57) ABSTRACT

A combination of a full-sized cremation urn and a keepsake-sized cremation urn comprises a full-sized container sized and configured to receive therein cremation remains of a deceased, the container including an externally threaded neck defining an opening and an internally threaded lid for closing the opening, and a keepsake-sized container sized and configured to receive therein only a portion of the cremation remains of the deceased, the container including a base plate, an upstanding externally threaded cylinder attached to the base plate and defining an opening, and an internally threaded lid for closing the opening. The full-sized container lid and the keepsake-sized container lid are substantially identical.

6 Claims, 5 Drawing Sheets

(56) References Cited

U.S. PATENT DOCUMENTS

| | | | | |
|---|---|---|---|---|
| D401,733 | S | 11/1998 | Thesken | |
| D403,896 | S | 1/1999 | Bartling et al. | |
| 5,875,528 | A | 3/1999 | Parker | |
| D415,329 | S | 10/1999 | Parker | |
| D418,271 | S | 12/1999 | Parker | |
| D419,745 | S | 1/2000 | Thesken | |
| 6,023,822 | A * | 2/2000 | Luebke | A61G 17/08 27/1 |
| 6,044,532 | A | 4/2000 | Bowling et al. | |
| D425,283 | S | 5/2000 | Thesken | |
| D434,201 | S | 11/2000 | Thesken | |
| D442,347 | S | 5/2001 | Parker | |
| D443,124 | S | 5/2001 | Parker | |
| D444,932 | S | 7/2001 | Greiwe et al. | |
| 6,295,705 | B1 * | 10/2001 | Gersten | A61G 17/08 220/4.27 |
| D489,508 | S | 5/2004 | Parker et al. | |
| 6,785,938 | B1 * | 9/2004 | Johansen, Jr. | A61G 17/08 27/1 |
| 7,178,209 | B1 * | 2/2007 | Radziewicz | A61G 17/08 27/1 |
| 9,198,819 | B2 | 12/2015 | Reynolds | |
| D759,338 | S | 6/2016 | Reynolds | |
| D812,337 | S | 3/2018 | Reynolds | |
| 2003/0024089 | A1 * | 2/2003 | Dziekonski | A61G 17/08 27/1 |
| 2005/0055812 | A1 * | 3/2005 | Fischer | A61G 17/08 27/1 |
| 2007/0084027 | A1 * | 4/2007 | Walczak | A61G 17/08 27/1 |
| 2012/0266424 | A1 * | 10/2012 | Martino | A61G 17/08 27/1 |

* cited by examiner

FULL-SIZED AND KEEPSAKE-SIZED CREMATION URNS

RELATED APPLICATIONS

This application claims the priority benefit of U.S. Provisional Patent Application No. 62/580,790 filed Nov. 2, 2017, which is hereby incorporated by reference herein as if fully set forth in its entirety.

FIELD OF THE INVENTION

This invention relates generally to cremation remains containers, and more particularly to cremation urns.

BACKGROUND OF THE INVENTION

Cremation is a growing segment of the funeral industry. Full-sized and keepsake-sized cremation urns are known. A keepsake-sized urn is typically a smaller or miniature version of a full-sized urn. In the event that the family of the deceased elects to bury the full-sized urn, or to place it in a columbarium niche, a small quantity of the cremation remains can be retained for placement in a keepsake-sized urn. The keepsake-sized urn can then be displayed in the usual manner.

There is a continuing demand for new and innovative styles and designs of cremation urns which are cost competitive.

SUMMARY OF THE INVENTION

In one aspect, a combination of a full-sized cremation urn and a keepsake-sized cremation urn is provided. The combination comprises a full-sized container sized and configured to receive therein cremation remains of a deceased, the container including an externally threaded neck defining an opening and an internally threaded lid for closing the opening, and a keepsake-sized container sized and configured to receive therein only a portion of the cremation remains of the deceased, the container including a base plate, an upstanding externally threaded cylinder attached to the base plate and defining an opening, and an internally threaded lid for closing the opening. The full-sized container lid and the keepsake-sized container lid are substantially identical.

The base plate can be circular. The external threads of the full-sized container neck and the external threads of the keepsake-sized container cylinder are the same thread pattern. The internal threads of the full-sized container lid and the internal threads of the keepsake-sized container lid are the same thread pattern.

In another aspect, a combination of a full-sized cremation urn and a keepsake-sized cremation urn is provided. The combination comprises a full-sized container sized and configured to receive therein cremation remains of a deceased, the container including a threaded neck defining an opening and a matingly threaded lid for closing the opening, and a keepsake-sized container sized and configured to receive therein only a portion of the cremation remains of the deceased, the container including a base plate, an upstanding threaded cylinder attached to the base plate and defining an opening, and a matingly threaded lid for closing the opening. The full-sized container lid and the keepsake-sized container lid are substantially identical.

In yet another aspect, a combination of a full-sized cremation urn and a keepsake-sized cremation urn is provided. The combination comprises a full-sized container sized and configured to receive therein cremation remains of a deceased, the container including a threaded neck defining an opening, a keepsake-sized container sized and configured to receive therein only a portion of the cremation remains of the deceased, the container including a base plate and an upstanding threaded cylinder attached to the base plate and defining an opening, and a common threaded lid that matingly threads onto both the threaded neck of the full-sized container and the threaded cylinder of the keepsake-sized container.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
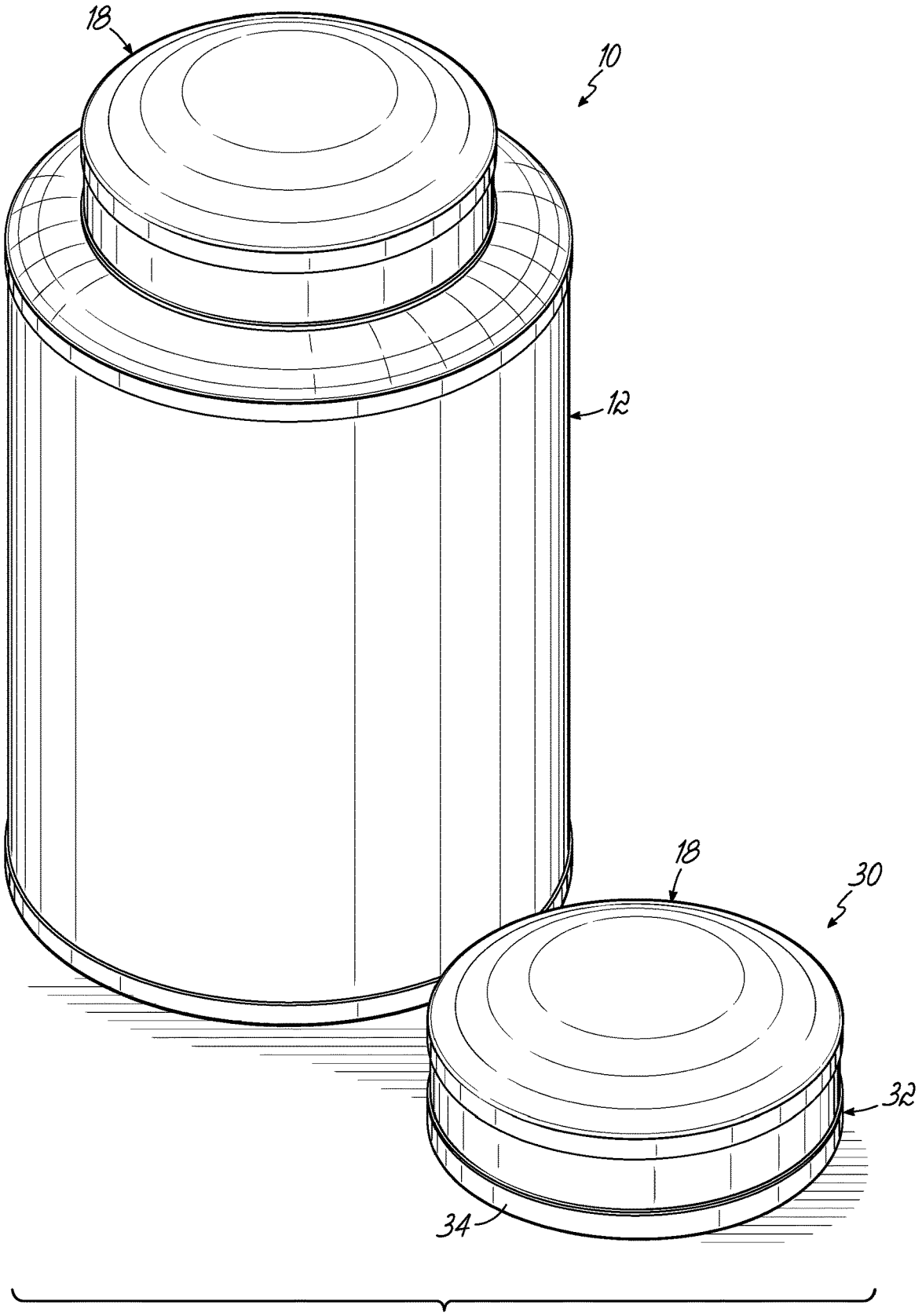
FIG. 1 is a top perspective view of a full-sized cremation urn and a keepsake-sized cremation urn of the present invention.
Figure 2:
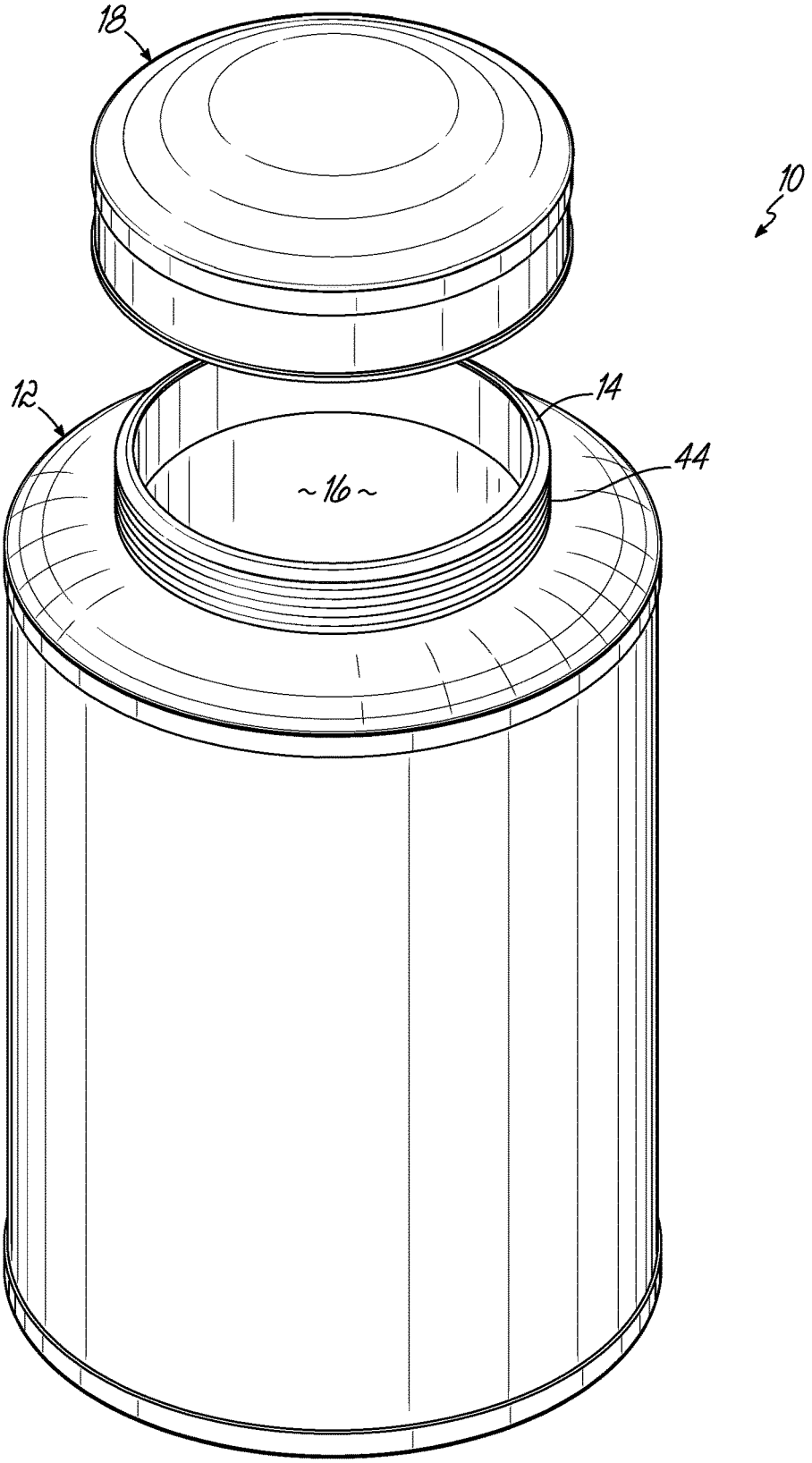
FIG. 2 is a top perspective view of the full-sized urn with the lid removed.
Figure 4A:
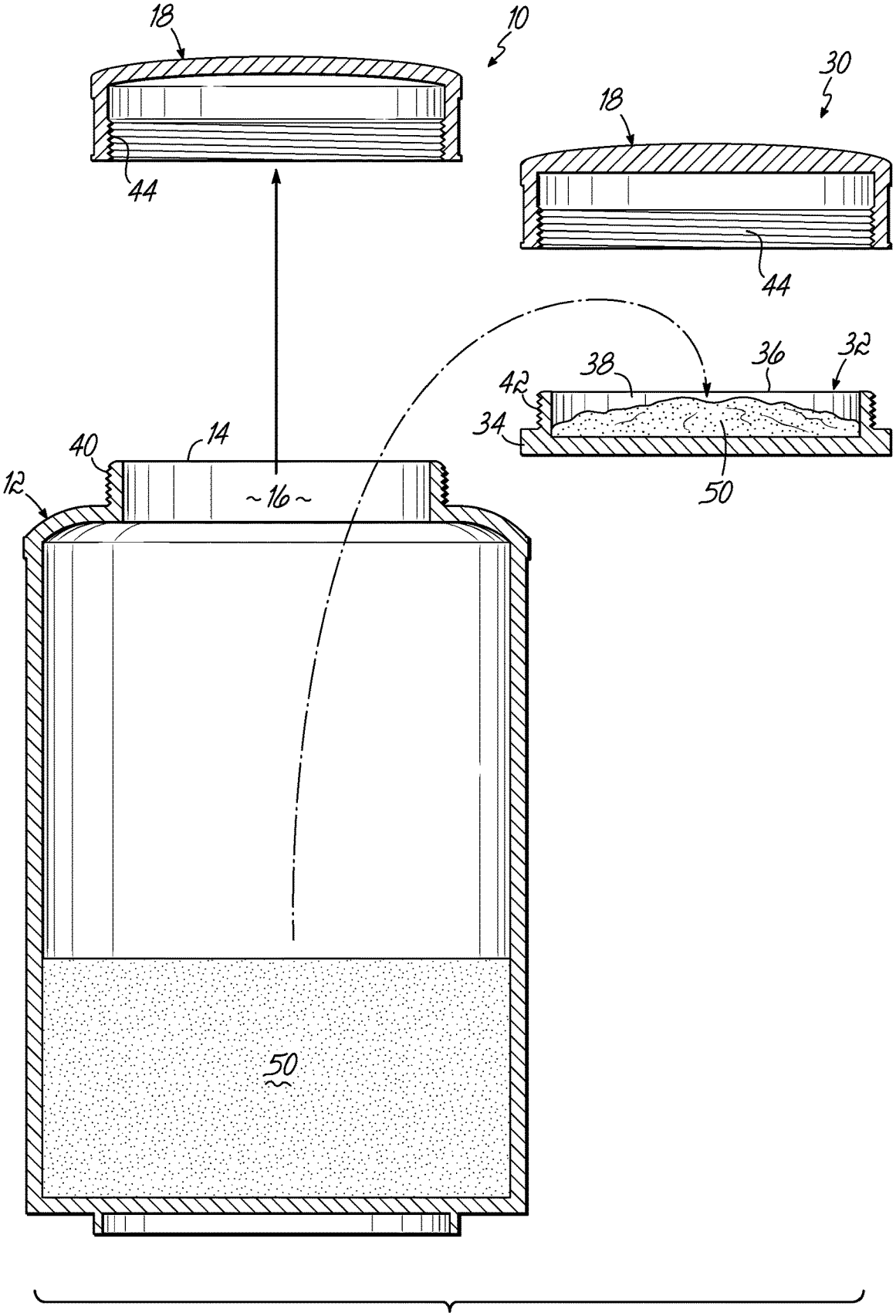
FIG. 4A is a vertical cross-sectional front view of the urns of FIG. 1 with lids removed.
Figure 4B:
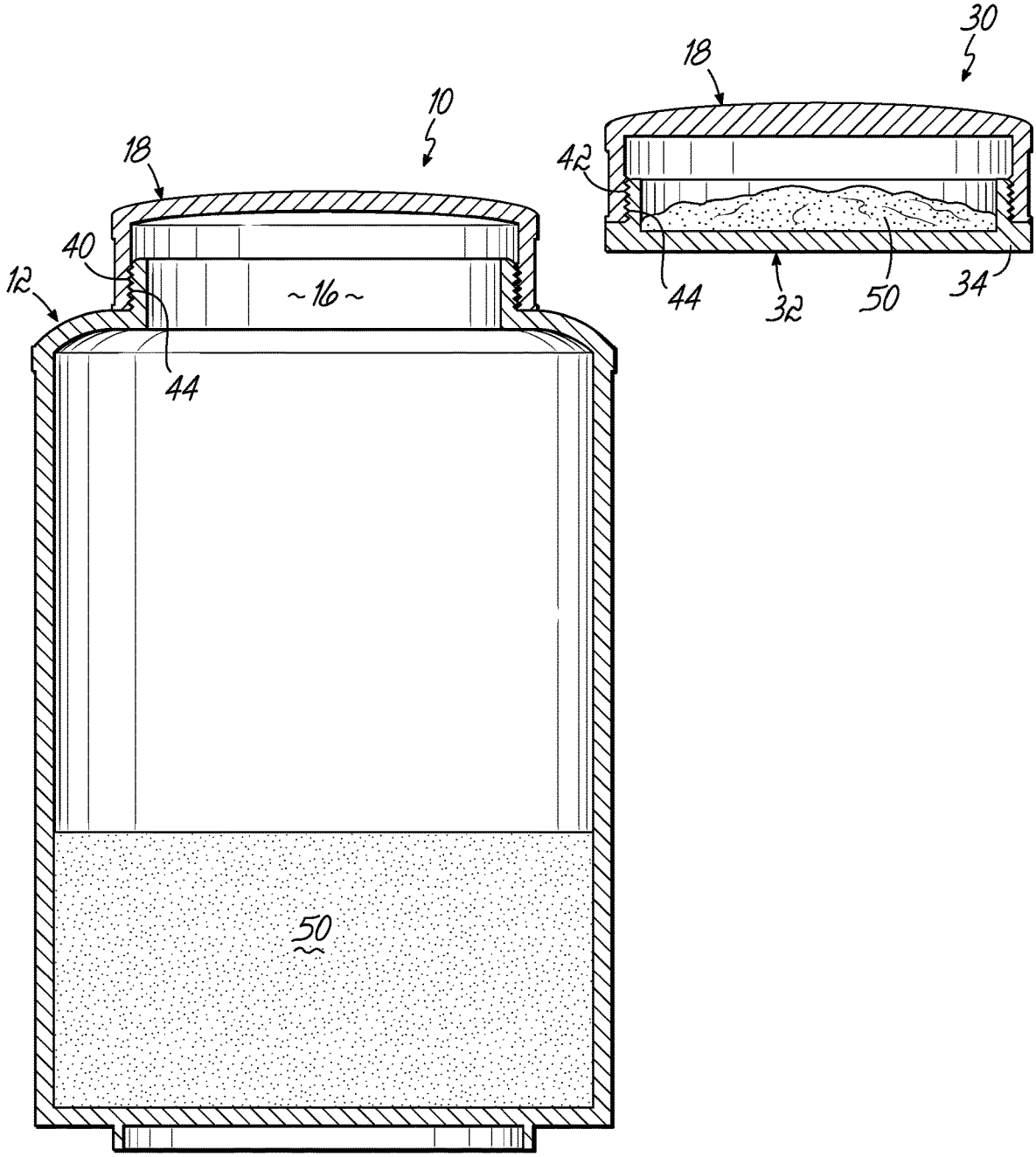
FIG. 4B is a view similar to FIG. 4A but with the lids installed.

Referring to FIGS. 1, 2, 4A, and 4B, there is illustrated a full-sized cremation urn 10 according to the principles of the present invention. The urn 10 includes a full-sized container 12 that is sized and configured to receive therein the cremation remains of a deceased. The invention is not limited to the particular surface ornamentation or overall configuration (shape) of the container 12, as the invention could be practiced with any other container of desired surface ornamentation and overall configuration. The container 12 includes an externally threaded neck 14 that defines an opening 16 into the container 12. The urn 10 further includes an internally threaded lid 18 for closing the opening 16.

Figure 3:
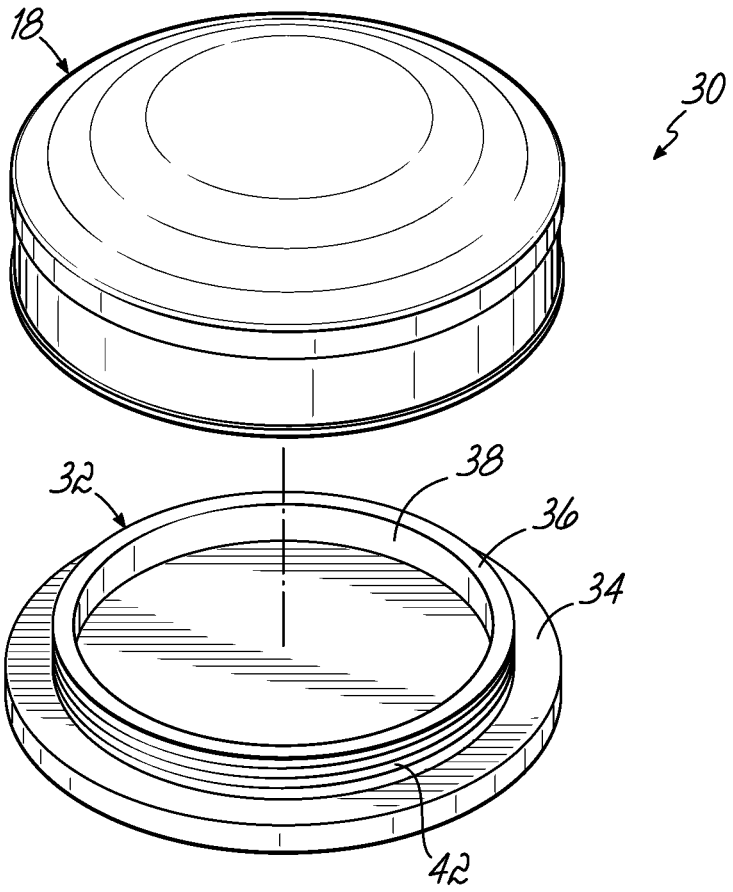
FIG. 3 is a top perspective view of the keepsake-sized urn with the lid removed.

Referring to FIGS. 1, 3, 4A, and 4B, there is illustrated a keepsake-sized cremation urn 30 according to the principles of the present invention. The urn 30 includes a keepsake-sized container 32 sized and configured to receive therein only a portion of the cremation remains of the deceased. The container includes a base plate 34 and an upstanding externally threaded cylinder 36 attached to the base plate 34. The cylinder 36 defines an opening 38. The urn 10 further includes the aforementioned internally threaded lid 18 for closing the opening 38.

The lid 18 is thus a common lid for both the full-sized urn 10 and the keepsake-sized urn 30. Accordingly, the threads 40 of the externally threaded neck 14 of the full-sized urn 10 are the same as the threads 42 of the externally threaded cylinder 36 of the keepsake-sized urn 30. The threads 44 of the internally threaded lid 18 thus mate with both the threads 40 of the externally threaded neck 14 of the full-sized urn 10 and the threads 42 of the externally threaded cylinder 36 of the keepsake-sized urn 30. In this way, a very economical, cost-effective keepsake-sized urn 30 is provided for purchase by a customer along with the full-sized urn 10, as the keepsake-sized container 32 is much more economical to manufacture than a miniature version of the full-sized container 12, and because only a single lid 18 for both urns 10 and 30 need be manufactured. Of course, the neck 14 of the full-sized urn 10 and the cylinder 36 of the keepsake-sized urn 30 could be internally threaded, and the lid 18 could be externally threaded. All such variations are within the scope of the invention.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. The invention resides in each individual feature described herein, alone, and in all combinations of any and all of those features. Departures may therefore be made from such details without departing from the spirit or scope of the general inventive concept. Accordingly, the scope of the invention shall be limited only by the following claims and their equivalents.

What is claimed is:

1. A combination of a full-sized cremation urn and a keepsake-sized cremation urn, comprising:

a full-sized container sized and configured to receive therein cremation remains of a deceased, said container including an externally threaded neck defining an opening and an internally threaded lid for closing said opening, and a keepsake-sized container sized and configured to receive therein only a portion of the cremation remains of the deceased, said container including a circular base plate, an upstanding externally threaded cylinder attached to said base plate and defining an opening, and an internally threaded lid for closing said opening, said keepsake-sized container lid having an outer diameter that is substantially identical to a diameter of said base plate, and said upstanding externally threaded cylinder having an outer diameter that is less than the diameter of said base plate, such that when said keepsake-sized container lid is completely threaded onto said upstanding externally threaded cylinder a lower edge surface of said keepsake-sized container lid abuts an upper peripheral surface of said base plate and an outer cylindrical surface of said keepsake-sized container lid is substantially flush with an outer cylindrical surface of said base plate, wherein said full-sized container lid and said keepsake-sized container lid are substantially identical.

2. The combination of claim 1 wherein said full-sized container is cylindrical and wherein the outer diameter of said full-sized container lid is substantially less than an outer diameter of said full-sized container.

3. The combination of claim 1 wherein said external threads of said full-sized container neck and said external threads of said keepsake-sized container cylinder are the same thread pattern.

4. The combination of claim 3 wherein said internal threads of said full-sized container lid and said internal threads of said keepsake-sized container lid are the same thread pattern.

5. A combination of a full-sized cremation urn and a keepsake-sized cremation urn, comprising:

a full-sized container sized and configured to receive therein cremation remains of a deceased, said container including a threaded neck defining an opening and a matingly threaded lid for closing said opening, and a keepsake-sized container sized and configured to receive therein only a portion of the cremation remains of the deceased, said container including a circular base plate, an upstanding threaded cylinder attached to said base plate and defining an opening, and a matingly threaded lid for closing said opening, said keepsake-sized container lid having an outer diameter that is substantially identical to a diameter of said base plate, and said upstanding externally threaded cylinder having an outer diameter that is less than the diameter of said base plate, such that when said keepsake-sized container lid is completely threaded onto said upstanding externally threaded cylinder a lower edge surface of said keepsake-sized container lid abuts an upper peripheral surface of said base plate and an outer cylindrical surface of said keepsake-sized container lid is substantially flush with an outer cylindrical surface of said base plate, wherein said full-sized container lid and said keepsake-sized container lid are substantially identical.

6. A combination of a full-sized cremation urn and a keepsake-sized cremation urn, comprising:

a full-sized container sized and configured to receive therein cremation remains of a deceased, said container including a threaded neck defining an opening, a keepsake-sized container sized and configured to receive therein only a portion of the cremation remains of the deceased, said container including a base plate and an upstanding threaded cylinder attached to said base plate and defining an opening, and a common threaded lid that matingly threads onto both said threaded neck of said full-sized container and said threaded cylinder of said keepsake-sized container.

* * * * *